United States Patent [19]

Goy

[11] Patent Number: 4,502,791

[45] Date of Patent: Mar. 5, 1985

[54] WATER-RESISTANT DEVICE BETWEEN AN OUTSIDE CONTROL MEMBER AND A WATCH CASE

[75] Inventor: Pierre Goy, Vaud, Switzerland

[73] Assignee: Jean Lassale S.A., Carouge, Switzerland

[21] Appl. No.: 490,207

[22] Filed: May 2, 1983

Related U.S. Application Data

[63] Continuation-in-part of Ser. No. 313,189, Oct. 20, 1981.

[30] Foreign Application Priority Data

Nov. 10, 1980 [CH] Switzerland ..... 8324/80
Jun. 29, 1981 [CH] Switzerland ..... 4270/81

[51] Int. Cl.[3] ..... G04B 37/00

[52] U.S. Cl. ..... 368/289; 368/308; 368/288

[58] Field of Search ..... 368/286, 289, 290, 291, 368/309, 319

[56] References Cited

U.S. PATENT DOCUMENTS 3,376,701 4/1968 Grohoski et al. ..... 368/289

FOREIGN PATENT DOCUMENTS 2030095 10/1970 France .
226489 7/1943 Switzerland .
348928 10/1960 Switzerland .

*Primary Examiner*—Bernard Roskoski
*Attorney, Agent, or Firm*—Young & Thompson

[57] ABSTRACT

This device comprises a groove (6) made in the internal wall of a through hole (2) of the case (1) giving passage to the stem (3) of the winding crown (4). A gasket (8) is placed in the groove (6). The internal diameter of the gasket (8) is less than the outside diameter of the stem (3) of the winding crown and is thus compacted between the stem (3) and the groove (6). The stem (3) is comprised by an internally screw-threaded pedestal (3') secured to the winding crown (4) and an externally screw-threaded winding stem (3") screwed into the pedestal (3'). As a result, the hole (2) can be made of relatively small diameter, which is an important advantage in an extra-thin watch whose case is of relatively soft precious metal, because the tendency to bend the case, that would be present in the case of a large hole, is overcome.

2 Claims, 2 Drawing Figures

WATER-RESISTANT DEVICE BETWEEN AN OUTSIDE CONTROL MEMBER AND A WATCH CASE

This application is a continuation-in-part of my copending application Ser. No. 313,189, filed Oct. 20, 1981.

There are numerous water-resistant devices for the winding crown of a watch movement which however do not give satisfaction for extra thin watch cases, i.e. of a thickness less than 4 mm which therefore have very thin cases.

In fact, these known devices for example of Swiss Pat. Nos. 250,115, 448,903, 496,273, or German Pat. No. 2,033,125 or U.S. Pat. No. 3,525,211 all provide for a sleeve surrounding the winding stem which increases greatly its diameter and leads therefore to the use of a thick case.

Other known devices have a gasket located in a circular groove of the winding stem. In such realizations one increases the length of the winding stem, its diameter at the place of the groove being too small to be pierced, and on the other hand the radial thickness of the case has to be increased to permit the displacement of the gasket according to the axial displacement of the winding crown.

There are further water-resistant devices described in the Swiss Pat. Nos. 252,164 and 210,633 comprising a tightening packing of tubular shape, in one part or made by the stacking of several washers, located in a housing machined in the case. The dimensions and the resilience of this packing are such that when the winding stem is introduced in it, the tightness between said stem and the case is ensured by compacting the packing. In these executions a ring is forced in the outside opening of the housing to maintain the packing in place.

The devices have several drawbacks:

a. The gasket or packing cannot be changed without removing the forced ring. This necessitates particular tools and skilled labor. Furthermore, for gold watches the risk to damage the case during this operation is great.

b. For extra-thin watches these devices cannot be used. In fact, the maintaining ring for the packing is so small, for example of an outside diameter of 1.7 mm. and of a thickness of 0.2 mm. that its fixing by driving is impossible. The tolerances which are necessary for such a driving on the diameter of the housing and the diameter of the ring become in fact impossible to respect.

Furthermore, in the case of cases of gold or other precious metal, the ring has also to be in gold or precious metal to avoid corrosion, and for such small dimensions this ring does not have any more the sufficient resistance to permit a driving without deformations.

Finally according to the Swiss regulations relating to the control of precious metals, it is necessary that all parts of a whole with a watch case be of the same material, metal and standard.

For all these reasons, the very old devices known from these patents cannot be used to secure the tightness of a precious metal, extra-thin watch case and a control member, push-piece or winding stem.

The present invention has for its object a miniature water-resistant device between an outside control member and an extra-thin watch case of precious metal comprising a gasket surrounding the stem of the control member housed in a housing provided in the case along a certain length of the bore giving passage to said stem, characterized by the fact that the gasket is a very supple toric gasket, by the fact that the housing in which the gasket is placed is comprised by a groove having a depth approximately equal to its height, by the fact that the height of said groove is less than $\frac{1}{3}$ of the thickness of the case, and by the fact that said groove is limited on both its side by a part of the same metal as the case and fast with it.

The attached drawing shows schematically and by way of example two embodiments of the water-resistant device according to the invention.

The water-resistant device between an outside control member and a watch case is particularly designed to ensure the tightness between an extra-thin case, having a thickness less than 4 mm., or even down to 2 mm. in certain cases and the stem of a winding crown which must undergo with respect to said case axial and angular displacements.

It can be noted, as an example, that such a case can have a diameter comprised between 24 and 32 mm. and a wall thickness of the order of 1.3 mm.

Figure 1:
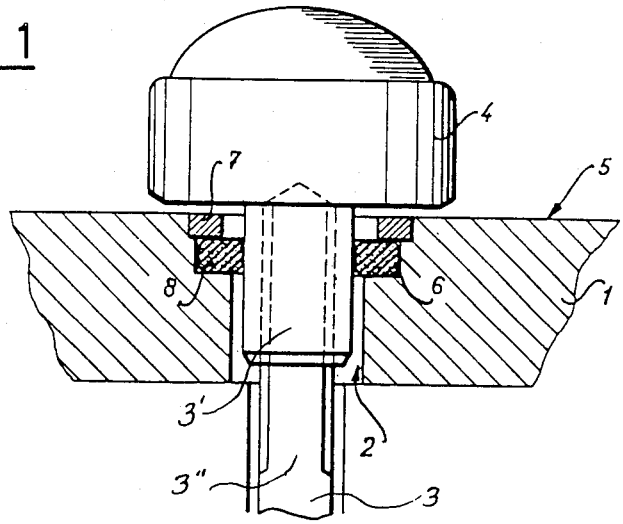
FIG. 1 is a cross-section along the axis of the stem of a winding crown.

With reference to FIG. 1, the case 1 comprises a through hole 2 of a diameter of about 1.05 mm. intended to give passage to the stem 3 having a diameter of 0.95 mm. of the winding crown 4. As seen in FIG. 1, stem 3 is comprised by an internally screw threaded pedestal 3' secured to crown 4 and an externally screw threaded winding stem 3'' screwed into pedestal 3'. The internal wall of the through hole 2 comprises, in the vicinity of the outside surface 5 of the case a circular groove 6 having a maximum diameter of 1.53 mm. and a height of about 0.4 mm. In the example shown the axial outside wall of this groove is comprised by a ring 7 fast with the case by welding or cementing in a housing coaxial to the through hole 2 and also provided in the case. It is evident that this ring is of the same precious metal as the case 1.

Due to the small dimensions of this ring 7, inside diameter 1.25 mm, outside diameter 1.7 mm, height 0.2 mm, it is impossible to drive it into the housing provided in the case to receive it, either because the tolerances for such a driving are impossible to realize or because the ring is deformed during the driving. That is why the ring 7, made in the same precious material, gold or platinum, as the case, is cemented or welded in its position.

Figure 2:
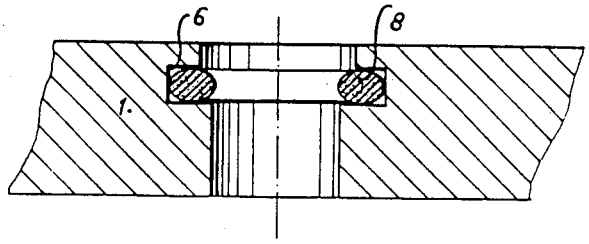
FIG. 2 shows in detail a variant.

In the variant shown in FIG. 2 the groove 6 is directly machined in the body of the case.

A toric very supple gasket 8 is placed in this groove 6 of the case and its height corresponds to the width of the groove 6 so that it is maintained in it. The outside diameter of the toric gasket 8 of about 1.6 mm corresponds approximately to the diameter of the bottom of the groove 6 whereas the inside diameter of the toric gasket is less than the outside diameter of the stem 3 of the winding crown 4.

Thus, when the winding crown is set in place, the gasket 8 is resiliently deformed and bears strongly against the wall of the groove 6 and on the cylindrical outside surface of the stem 3 so as to realize a tight seal between the winding crown and the middle.

In this realization, tests have shown that one can secure the tightness up to several atmospheres, for example 4 atmospheres by means of a simple water-resistant device which does not comprise any superfluous part.

Furthermore, the gasket is well maintained by the groove and cannot displace itself nor be damaged during the axial displacements of the winding crown, in fact, the smooth surface of the stem 3 slides in the gasket 8 while securing the tightness.

The case is not weakened and the dimension of the groove being small, the radial thickness of said case can be maintained very small.

The height of the groove is less than $\frac{1}{3}$ of the thickness of the wall of the case which is therefore not weakened.

The stem 3 has no groove and can be pierced beyond the gasket 8 to receive the winding stem so that the outside diameter of the case can be reduced as well as the length of the stem 3.

It is important that the gasket be toric and supple to be set in place in the groove 6 without removing the ring 7. A replacement of the gasket can be therefore done without any intervention on the case.

The present solution is very simple, robust, and overcomes the drawbacks of the known devices for extra-thin watches.

It is particularly to be noted that the formation of stem 3 as an internally screw-threaded pedestal 3' secured to crown 4 and an externally screw-threaded winding stem 3'' screwed into pedestal 3', permits the external diameter of the stem 3, and more particularly pedestal 3' thereof, to be as small as possible. This enables the hole 2 to be of reduced internal diameter, which in turn reduces the tendency toward bending of the case 1 adjacent the hole 2 when, as in the present invention, the wall of the case is very thin and of a relatively soft precious metal.

What is claimed is:

1. An extra-thin watch case of precious metal having a wall having a hole therethrough, a winding crown disposed entirely outside the case and overlying one outermost surface of the case and overlying said hole, an internally screw threaded pedestal secured to the crown and extending into the hole, an externally screw threaded winding stem screwed into the pedestal, an annular groove in said wall within said hole, the groove having a depth approximately equal to its height, the height of the groove being less than one third the thickness of the wall, the groove being limited on both sides by a part which is of the same precious metal as the case and which is fast with the case, and a supple toric gasket in the groove and surrounding and contacting said pedestal.

2. Device according to claim 1, characterized by the fact that the face has a thickness of about 1.3 mm, the hole has a diameter of about 1.05 mm, the stem has a diameter of about 0.95 mm, the groove has a maximum diameter of about 1.53 mm and a height of about 0.4 mm, the gasket has an undeformed inside diameter of about 0.25 mm, an undeformed outside diameter of about 1.6–1.7 mm, and an undeformed height of about 0.2 mm.

* * * * *